US005794859A

United States Patent [19]

Goenka et al.

[11] Patent Number: 5,794,859

[45] Date of Patent: Aug. 18, 1998

[54] MATRIX ARRAY SPRAY HEAD

[75] Inventors: Lakhi Nandlal Goenka, Ann Arbor; Jay DeAvis Baker, Dearborn; Hossein Nivi, Novi, all of Mich.

[73] Assignee: Ford Motor Company, Dearborn, Mich.

[21] Appl. No.: 757,354

[22] Filed: Nov. 27, 1996

[51] Int. Cl.[6] ..... B05B 1/14

[52] U.S. Cl. ..... 239/555; 239/562

[58] Field of Search ..... 239/413, 414, 239/554, 555, 562, 99

[56] References Cited

U.S. PATENT DOCUMENTS

| | | | |
|---|---|---|---|
| 2,233,304 | 2/1941 | Bleakley | 91/12.2 |
| 2,800,419 | 7/1957 | Kough . | |
| 4,171,777 | 10/1979 | Behr | 239/422 |
| 4,291,316 | 9/1981 | Kakeno et al. | 346/140 R |
| 4,349,156 | 9/1982 | Haruch et al. | 239/432 |
| 4,416,421 | 11/1983 | Browning | 239/79 |
| 4,527,507 | 7/1985 | Sawai et al. | 118/314 |
| 4,564,846 | 1/1986 | Siegal | 346/75 |
| 4,619,845 | 10/1986 | Ayers et al. | 427/422 |
| 5,030,971 | 7/1991 | Drake et al. | 346/140 R |
| 5,080,285 | 1/1992 | Toth | 239/300 |
| 5,203,843 | 4/1993 | Hoy et al. | 239/135 |
| 5,302,414 | 4/1994 | Alkhimov et al. | 427/192 |
| 5,390,450 | 2/1995 | Goenka | 451/75 |
| 5,419,348 | 5/1995 | Kuta | 134/58 R |
| 5,514,024 | 5/1996 | Goenka | 451/39 |
| 5,516,043 | 5/1996 | Manna et al. | 239/102.2 |
| 5,524,660 | 6/1996 | Dugan | 137/14 |
| 5,545,073 | 8/1996 | Kneisel et al. | 451/39 |
| 5,549,246 | 8/1996 | Kukesh | 239/9 |

OTHER PUBLICATIONS

"Sonimist Ultrasonic Spray Nozzles", Technical Bulletin of Heat Systems–Ultrsonics, Inc., 1938 New Highway, Farmingdate, N.Y. 11735, 5 pgs.

U.S.S.N. 08/585,987, Filed Jun. 16, 1996, Lakhi Goenka.

"Shape Memory Alloys", by Darel E. Hodgson et al, 1990 Metals Handbook, Tenth Edition, vol. 2, pp. 897–902.

*Primary Examiner*—Lesley D. Morris

*Attorney, Agent, or Firm*—Leslie C. Hodges; Roger L. May

[57] ABSTRACT

A matrix array spray head including a valve section for controlling nozzles is disclosed. The spray head is formed by a series of alternately stacked plates having channels formed in alternate plates for supplying either pressurized gaseous propellant or a composition to be applied by the spray head. Compositions appropriate for spraying with the spray head include paint powder, liquid paint, conformal coatings, flux, water and other materials and fluids which may be atomized when combined with a high pressure gaseous stream. Flow of the composition and gaseous stream may be controlled in the valve section by means of memory metal valves having memory metal valve elements that move in response to the application of electrical current controlled by a logic control. The computer logic control of the valves provides a spray head having a computer-addressable array of tiny spray nozzles.

7 Claims, 2 Drawing Sheets

MATRIX ARRAY SPRAY HEAD

TECHNICAL FIELD

The present invention relates to a multiple nozzle spray head for spraying paint or other compositions.

BACKGROUND ART

Spray nozzles have been developed to transfer paint powder, liquid paint, conformal coatings, flux and other materials and fluids in a high pressure gaseous stream. Spray nozzles have been developed such as that disclosed in U.S. Pat. No. 5,549,246 to spray plural component materials toward each other in a compressed air stream. This type of nozzle construction is a very complex and intricate construction having many component parts.

Similarly, as disclosed in U.S. Pat. No. 4,564,846, dot matrix printing heads have been developed for printing wherein discrete droplets are projected from a matrix printing head. Individual dots of supply ink are provided by a manifold to dot valves arranged in columns. The valves are electrically actuated to form the dots of the dot matrix in a matrix relationship.

There is a need for a compact matrix array spray head which includes a matrix of tiny spray nozzles mounted on the spray head for depositing paint, conformal coating, flux, water, or other materials. The tiny spray nozzles can be arranged in a matrix array so that different coatings such as different colored paints or conformal coatings and flux can be applied in a tightly focused pattern onto a workpiece.

The size and complexity of the spray head are preferably minimized to allow the spray head to be used in confined areas. As an example of an application where such a matrix array paint spray head is needed is in the decoration of instrument panel displays wherein several colors of paint are applied to provide the decorative displays observed by the vehicle driver. A matrix array paint spray head capable of performing such a function would require selectively and precisely controlled valving.

These and other problems and disadvantages associated with prior art spray heads are addressed by applicants' invention as summarized below.

SUMMARY OF THE INVENTION

The present invention relates to a matrix array spray head comprising a plurality of nozzles arranged in a matrix. Each nozzle has channels for mixing in the spray head a pressurized gaseous propellant and a composition to be applied to a workpiece. A plurality of plates are arranged in a stacked relationship to define channels for supplying the pressurized gaseous propellant, supplying the composition, mixing, and directing the pressurized gaseous propellant and composition. A plurality of gas supply valves associated with each channel for supplying pressurized gaseous propellant are each provided with an independently and selectively controlled valve element which is movable between a flow blocking position and a flow position. A plurality of composition supply valves associated with each channel for supplying the composition are each independently selectively controlled by a valve element which is movable between a flow blocking position and a flow position. A logic control selectively moves the gas supply and composition supply valves of selected nozzles as dictated by the pattern to be generated by the matrix array spray head.

The valve elements are preferably formed at least in part of memory metal which is connected to an electrical circuit controlled by the logic control. The memory metal changes shape in response to application of heat caused by the application of electrical current. By heating and cooling the memory metal, the valve elements are moved between the flow blocking and flow positions.

According to another aspect of the invention, the channels formed in the plates are formed by silicon micromachining. The gas supply valves and composition supply valves may also be formed by silicon micromachining portions of the plates or a separate valve matrix plate. The valve elements are assembled to the portions which have been silicon micromachined so that as current is applied to the memory metal valve elements, the elements are moved between flow blocking and flow positions.

It is an object of the invention to provide a simple sandwich construction for a matrix array spray head wherein multiple layers, each including several nozzles per layer, cooperate to provide a valve. In a preferred embodiment, the layers are alternately provided with compressed air supply channels and composition supply channels.

It is another object of the invention to provide a matrix array spray head which utilizes memory metal valves which are simple and compact and can be designed to provide precise control allowing for quick turn on and off of the composition to be applied by the spray head.

It is another object to provide a matrix array spray head including valves which are durable and simple.

It is yet another object of the invention to provide a simple matrix array spray head having the minimum number of moving parts required to provide a plurality of tiny paint spray nozzles mounted around a spray head for deposition of paint, conformal coating, flux, or other compositions in silicon micromachined channels formed in a sandwich construction spray head.

It is still another object of the invention to provide a matrix array spray head which makes it possible to make a computer-addressable array of tiny spray nozzles.

It is a further object of the invention to provide silicon micromachined spray nozzles that can be computer-actuated as necessary to obtain a focused deposition of paint or other coating onto a workpiece while minimizing overspray of paint and improving paint transfer efficiency.

These and other objects, features, and advantages of the present invention will be understood in view of the attached drawings and in light of the following detailed description of preferred embodiments of the invention.

Best Mode For Carrying Out The Invention

Figure 1:
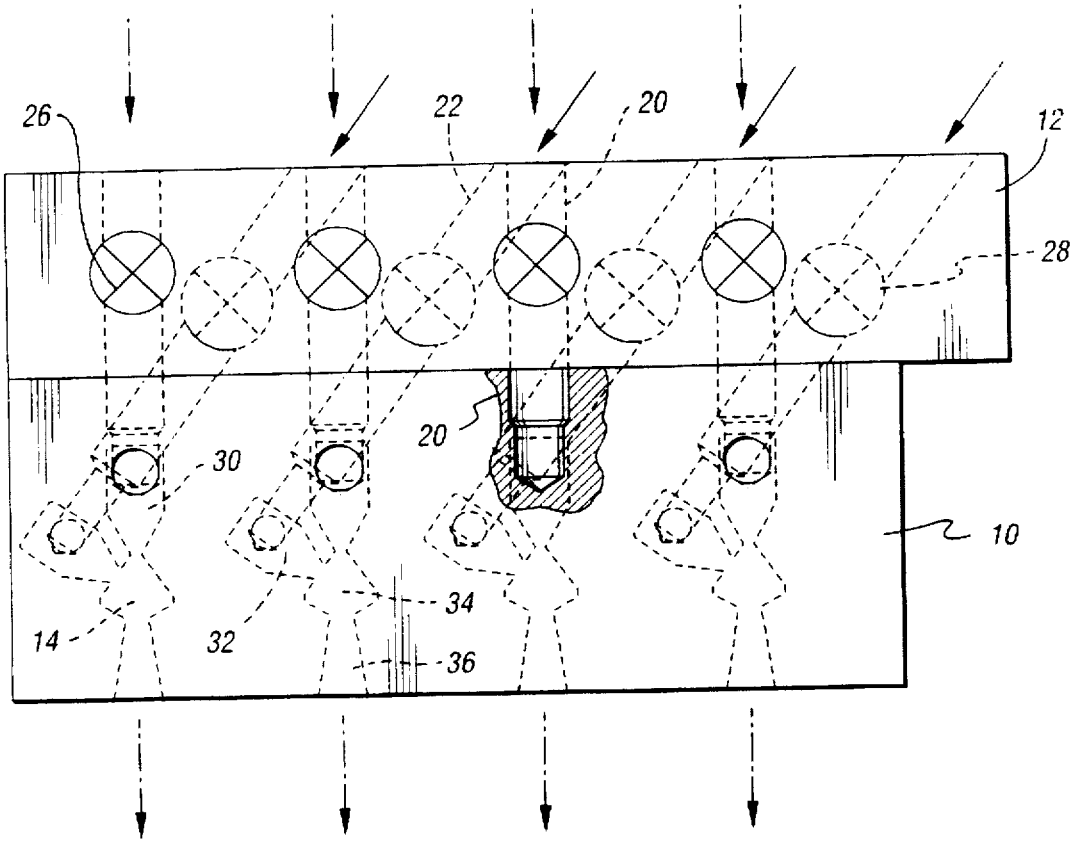
FIG. 1 is a top plan view partially fragmented away of matrix array spray head and valve section made in accordance with the present invention.
Figure 2:
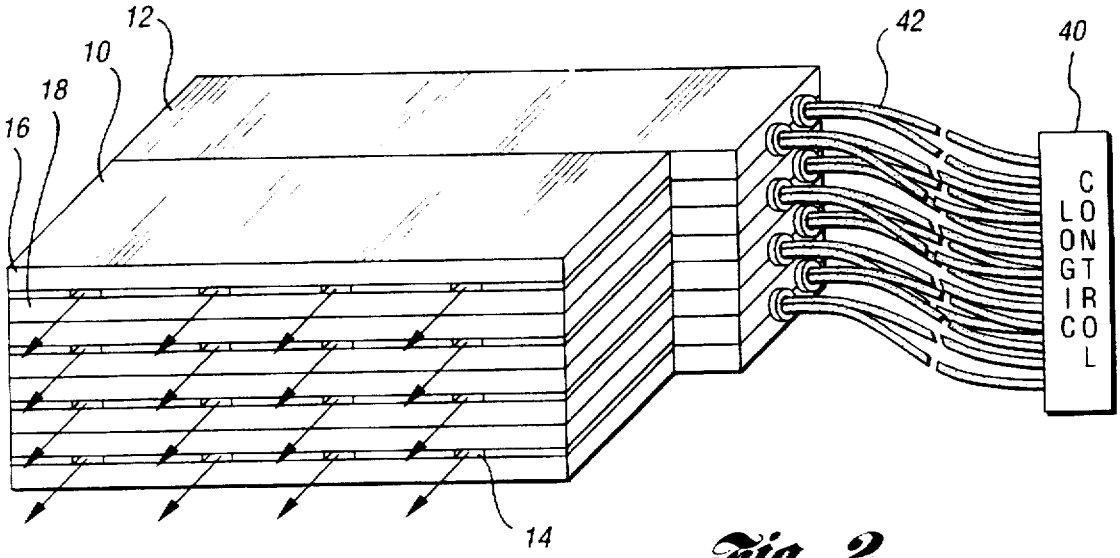
FIG. 2 is a perspective view of a matrix array spray head and valve section made in accordance with the present invention.

Referring now to FIGS. 1 and 2, a matrix array spray head 10 and its associated valve section 12 are illustrated. The matrix array spray head 10 includes a plurality of nozzles 14 through which atomized compositions are sprayed in a controlled pattern. The nozzles 14 are preferably very small and computer-actuated as necessary to obtain a focused deposition on a workpiece. The nozzles are actuated using valves contained in the valve section 12 as will be more fully described below. While memory metal valves are disclosed, other types of valves may be incorporated in the invention without departing from the scope of the invention. The matrix array spray head provides a computer-addressable array of tiny spray nozzles.

The matrix is formed by arranging a plurality of plates in a stacked relationship including a propellant plate 16 and composition plate 18. A propellent channel 20 is provided in the propellent plate 16. A composition channel 22 is provided in the composition plate 18.

Compressed air or another propellent is directed through the propellent channel 20 at a pressure of up to 150 psig. A composition such as liquid paint, paint powder, conformal coating, flux, water, or other fluid to be atomized or sprayed with the propellent is provided through the composition channel which extends through the composition plate at a pressure of up to 90 psig.

The valve section 12 includes propellent valve elements 26 and composition valve elements 28 which are associated with the propellent channel 20 and composition channel 22, respectively. The propellent is directed through the propellent valve element 26 and the propellent channel 20 into a propellent chamber 30 of the nozzle 14. The composition to be deposited is directed by the composition valve element 28 through the composition channel 22 through the composition plate 18 into a composition chamber 32.

The propellent is directed through a mixing chamber 34 where it mixes with the composition which has been provided to the composition chamber 32. The composition is atomized in the mixing chamber 34 and directed with the propellent through the spray opening 36 of the nozzle 14.

Logic control 40 is electrically connected by wires 42 to the valve sections to control operation of the valve elements 26 and 28.

Figure 3:
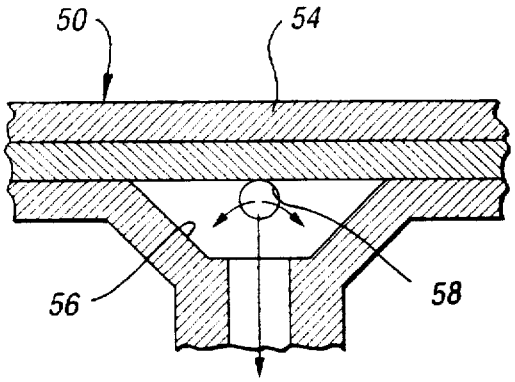
FIG. 3 is a cross-sectional view of a memory metal valve made in accordance with the present invention showing the valve in its open position.
Figure 4:
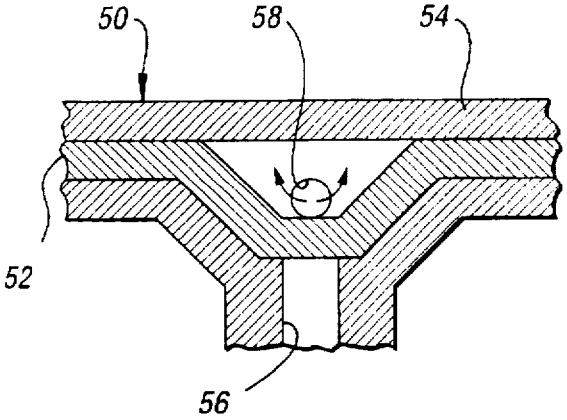
FIG. 4 is a cross-sectional view of a memory metal valve made in accordance with the present invention showing the valve in its flow blocking position.

Referring now to FIGS. 3 and 4, a memory metal valve 50 made in accordance with one embodiment of the present invention is illustrated. The memory metal valve 50 includes a memory metal actuator 52 which is restrained between a base plate 54 and a valve port 56. The memory metal actuator 52 is movable between the open position shown in FIG. 3 to the closed position shown in FIG. 4 by the application of electrical energy to the memory metal actuator 52 through the wires 42 in response to commands of the logic control 40. The memory metal actuator 52 allows flow from the supply orifice 58 through the valve port 56 when the memory metal valve 50 is in the position shown in FIG. 3 and prevents such flow when in the position shown in FIG. 4.

Figure 5:
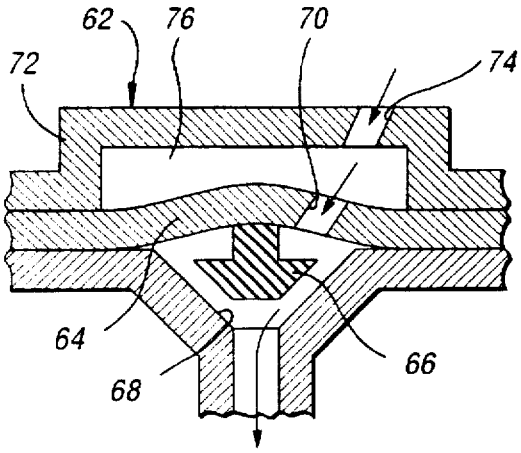
FIG. 5 is a cross-sectional view of an alternative embodiment of a memory metal valve made in accordance with the present invention in its open position.
Figure 6:
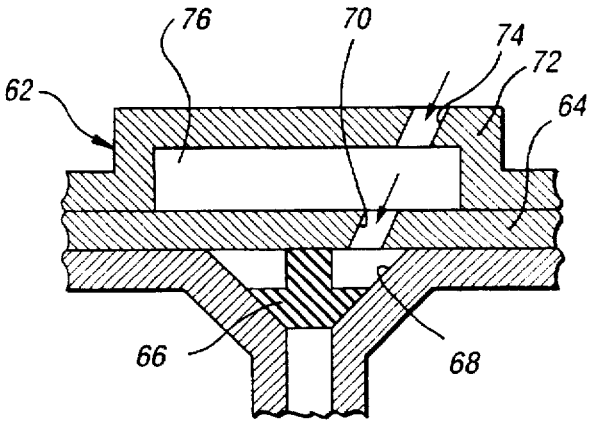
FIG. 6 is a cross-sectional view of a memory metal valve made in accordance with the present invention in its flow blocking position.

Referring now to FIGS. 5 and 6, an alternative embodiment of a memory metal valve is shown wherein the memory metal actuator layer 64 is moved from an open position as shown in FIG. 5 to a closed position as shown in FIG. 6. A projection 66 is secured to the memory metal actuator layer 64 and moved between the open position shown in FIG. 5 to the closed position shown in FIG. 6. The projection 66, as shown in FIG. 6, is moved to a closing position over valve seat 68. A valve port 70 is provided through the memory metal actuator layer 64. Back plate 72 includes supply orifice 74 through which pressurized material such as the gaseous propellent or the composition to be applied is supplied to the plenum 76. From the plenum 76, the pressurized material flows through the valve port 70 when the memory metal valve is in the position shown in FIG. 5.

It will be readily appreciated by one of ordinary skill in the art that the above description of the present invention may be modified without departing from the spirit and scope of the present invention. The scope of the present invention should be interpreted based upon the following broad claims to the invention.

What is claimed is:

1. A matrix array spray head comprising a plurality of nozzles forming a spray head, each of said nozzles mixing a pressurized gaseous propellant and a composition to be applied to a workpiece by the spray head, comprising:

a plurality of plates arranged in a stacked relationship and having channels formed therein for supplying the pressurized gaseous propellant, the composition, and for mixing and spraying the pressurized gaseous propellant and composition;

a plurality of gas supply valves are provided with each being associated with one channel for supplying pressurized gaseous propellant, said gas supply valves each having an independently selectively controlled valve element which is movable between a flow blocking position and a flow position;

a plurality of composition supply valves are provided with each being associated with one channel for supplying the composition, said composition supply valves each having an independently selectively controlled valve element which is movable between a flow blocking position and a flow position; and a logic control selectively opening gas supply valves and composition supply valves of selected nozzles.

2. The apparatus as described in claim 1 wherein said valve elements are formed, at least in part, of memory metal, said memory metal links being connected to an electrical circuit controlled by the logic control.

3. The apparatus as described in claim 1 wherein the gas supply valves and composition supply valves are formed by silicon micromachining.

4. The apparatus as described in claim 3 wherein the channels for supplying the gaseous propellant and composition are formed by silicon micromachining.

5. The apparatus as described in claim 1 wherein the plurality of plates are stacked to alternately provide compressed air supply channels and composition supply channels.

6. The apparatus as described in claim 1 wherein the composition is selected from the group comprising liquid paint, powdered paint, conformal coating, flux, water, or other fluid.

7. The apparatus as described in claim 1 wherein the logic control is a computer logic control and the nozzles are a computer-addressable array of tiny nozzles.

* * * * *